US005749470A

United States Patent [19]

Operschall et al.

[11] Patent Number: 5,749,470

[45] Date of Patent: May 12, 1998

[54] INSTALLATION FOR DECONTAMINATING A RADIOACTIVELY CONTAMINATED SURFACE

[75] Inventors: Hermann Operschall, Lauf; Jakob Weber, Baiersdorf; Klaus-Alfred Steiner; Stefan Ring, both of Erlangen, all of Germany

[73] Assignee: Siemens Aktiengesellschaft, Munich, Germany

[21] Appl. No.: 569,717

[22] Filed: Dec. 8, 1995

[30] Foreign Application Priority Data

Jun. 8, 1993 [DE] Germany ..... 43 19 095.2

[51] Int. Cl.[6] ..... B03B 9/00

[52] U.S. Cl. ..... 209/2; 209/31; 209/715; 209/716; 209/147

[58] Field of Search ..... 209/715, 716, 209/722, 146, 147, 142, 2, 31, 30; 451/87, 88, 447

[56] References Cited

U.S. PATENT DOCUMENTS

| | | | |
|---|---|---|---|
| 4,993,200 | 2/1991 | Morioka et al. . | |
| 5,107,630 | 4/1992 | Lodewijk | 451/88 |
| 5,291,697 | 3/1994 | Nelson . | |
| 5,529,530 | 6/1996 | McPhee et al. | 451/88 |

FOREIGN PATENT DOCUMENTS

| | | |
|---|---|---|
| 32 30 375 | 8/1984 | Germany . |
| 30 17 590 | 5/1988 | Germany . |
| 30 01 289 | 5/1990 | Germany . |
| 40 17 998 | 3/1993 | Germany . |
| 91/18712 | 12/1991 | WIPO . |

OTHER PUBLICATIONS

Japanese Patent Abstract No. JP 59–209765 (Masao et al. Apr. 10, 1985).

Japanese Patent Abstract No. JP 59–174735 (Masami et al), Oct. 3, 1984.

*Primary Examiner*—David H. Bollinger

*Attorney, Agent, or Firm*—Herbert L. Lerner; Laurnece A. Greenberg

[57] ABSTRACT

An installation for decontaminating a radioactively contaminated surface with a dry mechanical abrasive includes an extractor for suction extraction of an extraction gas together with an abrasive/dust mixture produced during blasting. A separator separates the abrasive/dust mixture aspirated by the extractor into a dust fraction and a re-usable abrasive fraction. A storage bin is connected between the extractor and the separator. The storage bin includes a filter device having a filter for filtering the extraction gas flowing through the storage bin to the extractor, and a blowoff line to be connected to the filter device for blowing off the filter.

6 Claims, 1 Drawing Sheet

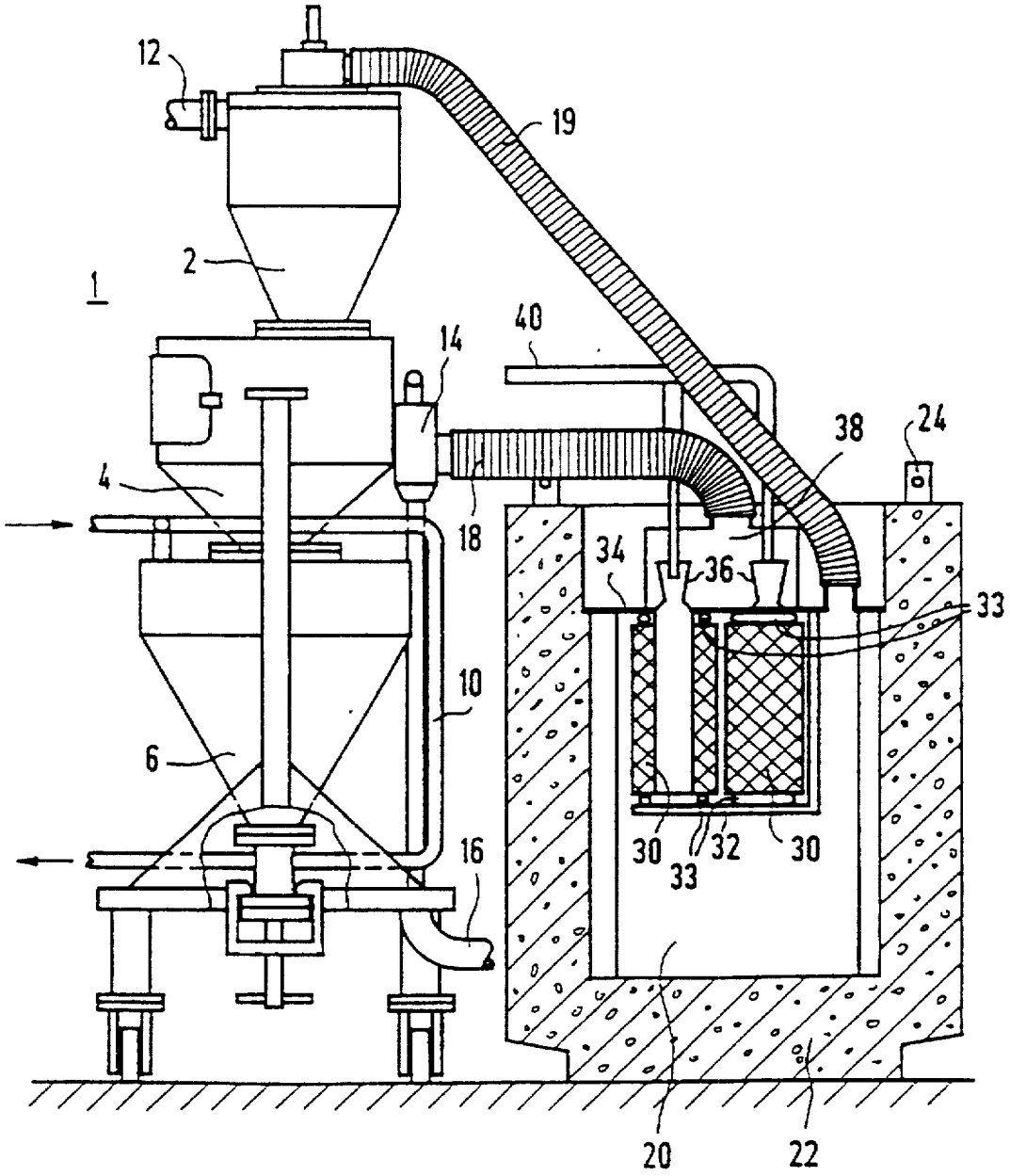
12
19
2
1
40
14
38
24
4
18
34
36
33
10
6
30
32
30
33
16
20
22

INSTALLATION FOR DECONTAMINATING A RADIOACTIVELY CONTAMINATED SURFACE

CROSS-REFERENCE TO RELATED APPLICATION

This application is a Continuation of International Application Serial No. PCT/DE94/00614, filed Jun. 1, 1994.

BACKGROUND OF THE INVENTION

Field of the Invention

The invention relates to an installation for decontaminating a radioactively contaminated surface.

Such an installation is known, for instance, from German Patent DE 40 17 998 C2, corresponding to Published International Application WO 91/18712.

During repair and inspection work in system parts of a nuclear facility, radioactively contaminated surfaces can result in high radiation exposure for repair workers. In order to keep the radiation exposure as low as possible, those surfaces must be decontaminated before the repair work is done. When steam generators in nuclear power plants are replaced, for instance, it is necessary to decontaminate exposed inner surfaces of stationary loop lines before beginning to join weld seams and doing actual welding work.

German Patent DE 40 17 998 C2, corresponding to Published International Application WO 91/18712, discloses a mobile apparatus for decontaminating an inner surface of a tube that is open on one end, for example a stationery loop line of a pressurized water reactor, after the steam generator has been disconnected, through a dry sandblasting process which uses a blasting system with a closed abrasive loop. That blasting system includes devices for separating the dry mixture of abrasive and dust being aspirated from a working volume, into two fractions of different particle size. A fraction having a larger mean particle size is fed to a pressurized container for re-use. In order to generate a negative pressure required for aspirating the mixture of abrasive and dust and for separating the dust from the abrasive, an injector operated with compressed gas is provided. Located between the cyclone filter and the device for separating the dust from the abrasive is a filter container, in which the compressed gas that has been aspirated by the injector and that even after leaving the separator (for example, a cyclone filter) still carries radioactive dust, is cleaned by an aerosol filter before emerging into the exterior through the injector.

A dust container is disposed below the filter in the filter container, outside the flow path of the compressed gas that transports the dust. In that container, some of the dust settles, because of the reduction in the flow velocity and since it is under the influence of gravity.

If both adequate throughput and a low flow velocity in the filter container, which allows the settling of dust, are to be attained, then a filter container with a large volume and an aerosol filter with a large surface area must be used. Moreover, the dust only settles in the dust container in a loose and not very compressed form and therefore the waste volume is relatively great. That loose accumulated dust, along with the large aerosol filters, must be disposed of in multiple, individual, high-dosage transports.

SUMMARY OF THE INVENTION

It is accordingly an object of the invention to provide an installation for decontaminating a radioactively contaminated surface, which overcomes the hereinafore-mentioned disadvantages of the heretofore-known devices of this general type and with which a further reduction of a dose load for workers operating a blasting system disposing of incident radioactive dust and filters as well as a reduction in a waste volume, are made possible.

With the objects of the invention in view, there is also provided an installation for decontaminating a radioactively contaminated surface with a dry mechanical abrasive, comprising an extractor for suction extraction of an extraction gas together with an abrasive/dust mixture produced during blasting; a separator for separating the abrasive/dust mixture aspirated by the extractor into a dust fraction and a re-usable abrasive fraction; and a storage bin connected between the extractor and the separator; the storage bin including a filter device having a filter for filtering the extraction gas flowing through the storage bin to the extractor, and a blowoff line to be connected to the filter device for blowing off the filter.

Radioactive dust with high activity collects in the storage bin and in the filter device.

Since the filters are disposed in the storage bin and can be disposed of together with the dust, the dose load for workers that is associated with the disposal is markedly reduced. Since the dust occurs at the filter and below the filter in relatively compact form in the storage bin, and no longer in small individual pots of relatively large idle volume, the waste volume is markedly reduced as compared with the known structure.

Since moreover the filter device in the storage bin can be connected to a blowoff line for blowing off the filters, the filters can be cleaned by exerting pressure in the opposite direction, and the dust adhering to the filter in compact form drops onto the floor of the storage bin, where it is present in markedly greater density than in the known device.

In accordance with another feature of the invention, the storage bin is additionally disposed in a closable shielding container, which brings about a further reduction in the dose load during operation of the blasting system and removal of the radioactive dust and the filters. Moreover, as compared with the known structure, the high-dosage operation of cleaning the filter housing after removal of the filter, which was necessary in the known structure in order to adhere to limit values for contamination and a dose rate in transporting radioactive materials, is dispensed with.

With an insulation according to the invention, the total time required is reduced by the lack of the need to change the conventional dust pots. Moreover, the waste volume is reduced by a factor of up to 5, so that for decontaminating a four-loop system with eight tube ends, a single storage bin with a volume of 200 liters is sufficient.

In accordance with a further feature of the invention, the extractor is a compressed-air-operated injector.

In accordance with an added feature of the invention, the extractor is a blower.

In accordance with an additional feature of the invention, the separator is a cyclone filter.

In accordance with a concomitant feature of the invention, there is provided a supply container disposed downstream of the separator for recovering the abrasive, and a pressurized container disposed downstream of the supply container, the storage bin being spatially separated from the separator, from the supply container and from the pressurized container.

Other features which are considered as characteristic for the invention are set forth in the appended claims.

Although the invention is illustrated and described herein as embodied in an installation for decontaminating a radioactively contaminated surface, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

The FIGURE of the drawing is a fragmentary, diagrammatic, partly longitudinal-sectional view of an exemplary embodiment of an installation according to the invention.

DESCRIPTION OF THE PREFERRED EMBODIMENTS

Referring now in detail to the single FIGURE of the drawing, there is seen an installation according to the invention for decontaminating a radioactively contaminated surface, which has a blasting system 1 with a closed abrasive loop. The blasting system 1 includes a separator 2, preferably a cyclone filter, which has an outlet that is disposed above a supply container 4. Recovered abrasive is collected in this supply container 4. The supply container 4 communicates through a non-illustrated drop valve with a pressurized container 6. This pressurized container 6 has an upper region which is connected to a pressure line 10, into which the recovered abrasive is fed through a supply valve disposed on a floor of the pressurized container 6.

A mixture of abrasive and dust that occurs in the blasting process is fed into the separator 2 through a suction line 12. A negative pressure required to operate the cyclone filter that is used as the separator 2 is generated through the use of an extractor 14, such as a blower, or an injector operated with compressed gas, preferably compressed air, which blows a cleaned extraction gas that is aspirated from the cyclone filter, into the surroundings through a gas outlet 16.

The separator 2, the supply container 4 and the pressurized container 6 are disposed together on a movable undercarriage and form a unit.

A storage bin 20 which, for instance, is made of steel, is located in a flow path of the extraction gas between the separator 2 and the extractor 14. The storage bin 20 is spatially separated from the movable unit that includes the separator 2, the supply container 4 and the pressurized container 6, and is additionally located in a shielding container 22, preferably a concrete shielding container 22, which can be sealed by a non-illustrated cap and which is provided with transport lugs 24 to make it easier to transport.

Connecting the storage bin 20 into the flow path of the extraction gas is preferably accomplished through flexible hose lines 18 and 19. More than one, and preferably three, parallel-connected, hollow-cylindrical aerosol filters 30 are disposed in the storage bin 20. The aerosol filters 30 are fastened between a mount 32 that is L-shaped in cross section and a cap 34 of the storage bin 20. Sealing rings 33 are located on each of the end surfaces of the cylindrical aerosol filters 30 and prevent dust-laden compressed gas from moving past the filters 30 into the exterior through the injector 14. In the filter 30 which is shown in section on the left in the drawing, it can be seen that an inner hollow chamber, facing away from the flow, discharges into a funnel-like outlet neck 36, which discharges into an interior of a filter head 38 disposed above the cap 34. This filter head 38 is connected to the extractor 14 through the flexible hose line 18.

Blowoff lines 40, which also discharge into the funnel-like outlet neck 36, are connected through a non-illustrated valve to a compressed air reservoir. A pulsed, sudden or forceful blowoff of the filters 30 can be performed through the blowoff lines 40, with the injector 14 turned off. The dust produced in the blasting treatment is deposited in compressed form on the filters 30, is still in compressed form in the storage bin 20 even after the blowoff and can be disposed of, together with the radioactively contaminated filters 30, without additional dismantling steps being taken, in a way that makes for only a low dose load for workers.

We claim:

1. An installation for suction extracting and separating a radioactively contaminated abrasive/dust mixture, comprising:

a) an extractor for suction extraction of an extraction gas together with an abrasive/dust mixture produced during blasting;

b) a separator disposed upstream of said extractor for separating the abrasive/dust mixture aspirated by said extractor into a dust fraction and a re-usable abrasive fraction;

c) a storage bin connected between said extractor and said separator;

d) said storage bin including a filter device having a filter for filtering the extraction gas flowing from said separator to said storage bin and then flowing through said storage bin to said extractor, and a blowoff line to be connected to said filter device for blowing off said filter.

2. The installation according to claim 1, including a sealable shielding container in which said storage bin is disposed.

3. The installation according to claim 1, wherein said extractor is a compressed-air-operated injector.

4. An installation for suction extracting and separating a radioactively contaminated abrasive/dust mixture, comprising:

a) a blower for suction extraction of an extraction gas together with an abrasive/dust mixture produced during blasting;

b) a separator disposed upstream of said blower for separating the abrasive/dust mixture aspirated by said blower into a dust fraction and a re-usable abrasive fraction; and c) a storage bin connected between said blower and said separator;

d) said storage bin including a filter device having a filter for filtering the extraction gas flowing from said separator to said storage bin and then flowing through said storage bin to said blower, and a blowoff line to be connected to said filter device for blowing off said filter.

5. An installation for suction extracting and separating a radioactively contaminated abrasive/dust mixture, comprising:

a) an extractor for suction extraction of an extraction gas together with an abrasive/dust mixture produced during blasting;

b) a cyclone filter disposed upstream of said extractor for separating the abrasive/dust mixture aspirated by said extractor into a dust fraction and a re-usable abrasive fraction; and c) a storage bin connected between said extractor and said cyclone filter;

d) said storage bin including a filter device having a filter for filtering the extraction gas flowing from said separator to said storage bin and then flowing through said storage bin to said extractor, and a blowoff line to be connected to said filter device for blowing off said filter.

6. An installation for suction extracting and separating a radioactively contaminated abrasive/dust mixture, comprising:

a) an extractor for suction extraction of an extraction gas together with an abrasive/dust mixture produced during blasting;

b) a separator disposed upstream of said extractor for separating the abrasive/dust mixture aspirated by said extractor into a dust fraction and a re-usable abrasive fraction;

c) a storage bin connected between said extractor and said separator;

d) said storage bin including a filter device having a filter for filtering the extraction gas flowing from said separator to said storage bin and then flowing through said storage bin to said extractor, and a blowoff line to be connected to said filter device for blowing off said filter;

e) a supply container disposed downstream of said separator for recovering the abrasive; and f) a pressurized container disposed downstream of said supply container, said storage bin being spatially separated from said separator, from said supply container and from said pressurized container.

* * * * *

UNITED STATES PATENT AND TRADEMARK OFFICE

CERTIFICATE OF CORRECTION

PATENT NO. : 5,749,470
DATED : May 12, 1998
INVENTOR(S) : Hermann Operschall et al.

It is certified that error appears in the above-indentified patent and that said Letters Patent is hereby corrected as shown below:

On the title page, item [63] should read:

-- Continuation of PCT/DE94/00614, June 1, 1994. --

Signed and Sealed this

Eighteenth Day of August, 1998

Bruce Lehman

*Attest:*

BRUCE LEHMAN

*Attesting Officer*

*Commissioner of Patents and Trademarks*